US005366028A

United States Patent [19]

Kobayashi

[11] Patent Number: 5,366,028

[45] Date of Patent: Nov. 22, 1994

[54] PATROL BOAT

[75] Inventor: Noboru Kobayashi, Iwata, Japan

[73] Assignee: Yamaha hatsudoki Kabushiki Kaisha, Iwata, Japan

[21] Appl. No.: 35,942

[22] Filed: Mar. 23, 1993

[30] Foreign Application Priority Data

Apr. 9, 1992 [JP] Japan ..... 4-088785

[51] Int. Cl.[5] ..... B63B 17/00

[52] U.S. Cl. ..... 114/362; 440/88; 441/80

[58] Field of Search ..... 114/362, 61; 440/88, 440/80; 441/82, 84

[56] References Cited

U.S. PATENT DOCUMENTS

| | | | |
|---|---|---|---|
| 3,998,176 | 12/1976 | Stout et al. | 114/61 X |
| 4,343,056 | 8/1982 | McDonald | 441/84 |
| 4,543,898 | 10/1985 | Castilla | 114/61 |
| 4,742,795 | 5/1988 | DePrey | 114/362 |

FOREIGN PATENT DOCUMENTS

| | | | |
|---|---|---|---|
| 2241445 | of 1973 | France . | |
| 2736873 | 8/1977 | Germany . | |
| 3429990 | 1/1985 | Germany | 441/80 |
| 1103935 | 2/1968 | United Kingdom | 114/61 |
| 1585865 | 10/1977 | United Kingdom . | |

*Primary Examiner*—Sherman Basinger

*Attorney, Agent, or Firm*—Knobbe, Martens, Olson & Bear

[57] ABSTRACT

A patrol or rescue boat that is formed with a catamaran hull so as to provide a generally open deck area that extends through the rear of the transom for facilitating the transfer of injured persons onto the deck area from the body of water. In addition, a removable front deck is also provided. The rear deck has a pivotal portion so as to facilitate transfer of injured persons onto the deck and then to form an enclosure so that heated water can be flooded into the deck from the cooling jacket of the engine so as to heat an injured person.

7 Claims, 6 Drawing Sheets

PATROL BOAT

BACKGROUND OF THE INVENTION

This invention relates to a patrol boat and more particularly to an improved watercraft that is designed for facilitating at sea rescue.

There is a need for a type of watercraft that is particularly useful in rescuing individuals at sea. Such a watercraft should be constructed in such a way as to permit high speed operation and yet be capable of easily moving an injured person from the body of water onto the watercraft for treatment and rescue purposes. The construction should be such that the individual can be conveniently moved from the body of water onto the deck of the watercraft with the minimum amount of disturbance to his body to avoid aggravating injuries.

It is, therefore, a principal object to this invention provide an improved rescue type of boat having a deck which is substantially flush with the water level for facilitating transportation of an injured person from the water onto the deck.

It is a further object to this invention to provide an improved deck arrangement for such a watercraft that will accommodate transfer of injured persons to the deck and which will also permit the injured person to recline on the deck and receive emergency treatment there, if desirable.

In some regards it also is desirable to provide a way in which the injured person may be easily transferred onto the deck and it is a further object to this invention to provide an improved arrangement for permitting an injured person to be drawn onto the deck from the body of water in which the person is floating.

In connection with this type of watercraft, it is very desirable if the deck can be positioned at the rear of the watercraft so that the injured person may be easily transferred to the deck. However, with conventional types of propulsion devices, such a rear deck position is not always possible.

It is, therefore, a still further object to this invention to provide an improved rescue boat propelled by jet propulsion units so as to facilitate a low rear deck onto which injured persons may be readily transferred from the body of water in which the watercraft is operating.

SUMMARY OF THE INVENTION

This invention is adapted to be embodied in a rescue boat that is comprised of a hull having a transom with a deck opening through the transom and having a rear portion disposed substantially at the water level for facilitating the entry of an injured person onto the deck.

DETAILED DESCRIPTION OF THE PREFERRED EMBODIMENT OF THE INVENTION

Figure 5:
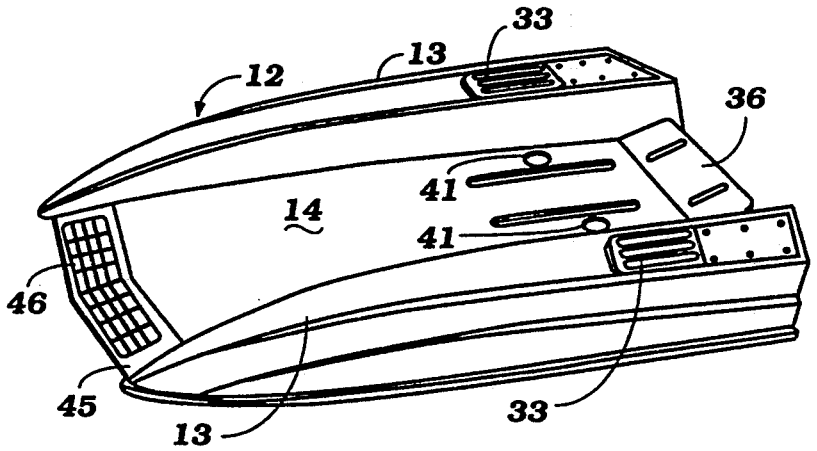
FIG. 5 is a perspective front side view of the underside of the hull showing the rear deck portion lowered.
Figure 6:
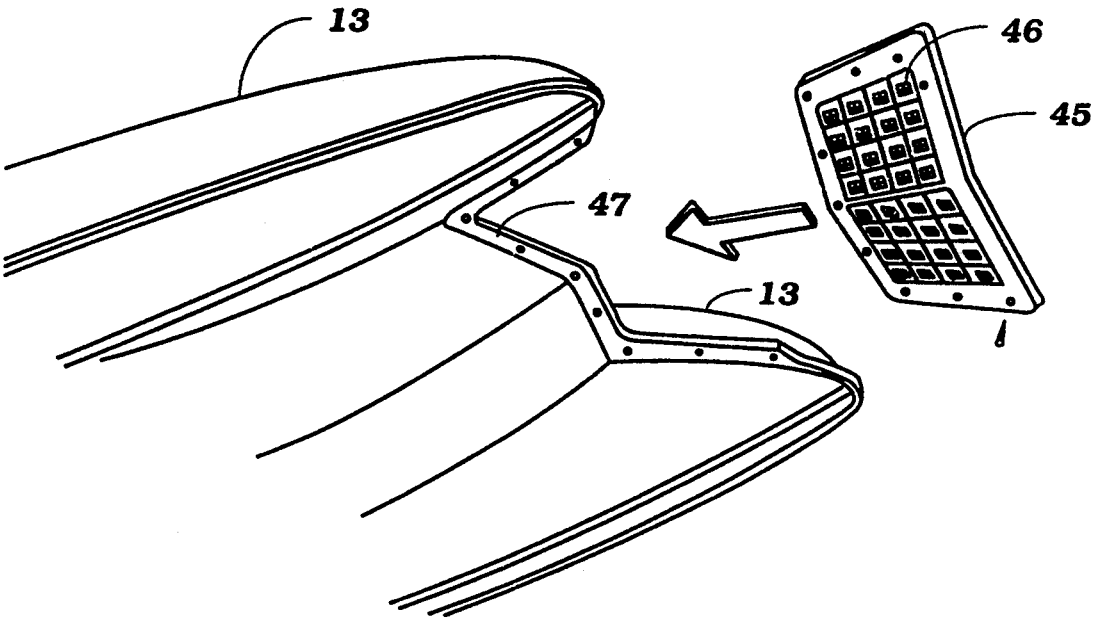
FIG. 6 is a partially exploded view showing the removable front deck portion.

In the drawings, a patrol or rescue watercraft constructed in accordance with an embodiment of the invention is identified generally by the reference numeral 11. The watercraft 11 is comprised of a hull having a lower portion, indicated generally by the reference numeral 12 which is configured as a catamaran as may be clearly seen in FIGS. 5 and 6 wherein there are provided a pair of spaced apart hull portions 13 separated by a recessed lower hull area 14. A deck, indicated generally by the reference numeral 15 is connected to the lower hull portion 12 in a suitable manner. The deck 15 and lower hull portion 12 are formed from suitable materials such as molded fiberglass reinforced resin or the like.

A rider's cockpit 16 is formed by the deck 15 and is located generally centrally in the longitudinal fore and aft direction of the watercraft 11. The rider's area 16 includes a pair of seats 17 with a watercraft control area 18 being positioned at the front of one of the seats 17. The rider's area 16 is designed so as to accommodate in addition to two seated passengers, individuals standing.

An enlarged storage area 19 is formed in the deck 15 forwardly of the rider's area 16 and is accessible through a pivotally supported hatch cover 21. The hatch cover 21 has a pivotal support to the deck 15 at its forward end for pivotal movement about a generally transversely extending axis so as to access the storage compartment 19. A stay 22 may be provided so as to permit retention of the hatch cover 15 in its open position.

Forwardly of the storage compartment 19, there is provided a further area 23 in which a fuel tank 24 is provided for containing fuel for the engines of the watercraft 11, as will be described. The fuel tank 24 may be accessible for filling through the hatch cover 21 when it is pivoted in an open position. Alternatively, an external fuel filler may be provided for the fuel tank 24. The areas under the seats 17 may accommodate a pair of batteries 25 for supply of electrical power for the watercraft 11.

It should be noted that the catamaran hull portions 13 extend generally forwardly beyond the forward periphery of the fuel tank 24 and thus provide an open area, for a purpose which will be described. In addition, the hull portions 13 are filled with a buoyant floatation media 26 such as a foamed plastic or the like and this buoyant material extends back to opposite sides of the rider's compartment 16.

At the rear portions of each of the catamaran hulls 13 there is provided an engine compartment 27 which is disposed rearwardly of the rider's compartment 16 and in which internal combustion engines 28 of any known type are accommodated. Rearwardly of the engine compartments 27 and separated therefrom by bulkheads 29 are tunnel areas 31 in which jet propulsion units 32 are supported. The jet propulsion units 32 are driven by the engines 28 respectively, and have downwardly facing water inlet openings 33. (FIG. 5) through which water is drawn. Impeller portions are formed behind the water inlet portions 33 and contain impellers driven by the engines 28. The water pumped by the impellers is then discharged through respective steering nozzles 34 that are supported for pivotal movement about vertically extending steering axes, as is well known in this art, and which are operated by the control 18 in a well known manner.

Figure 7:
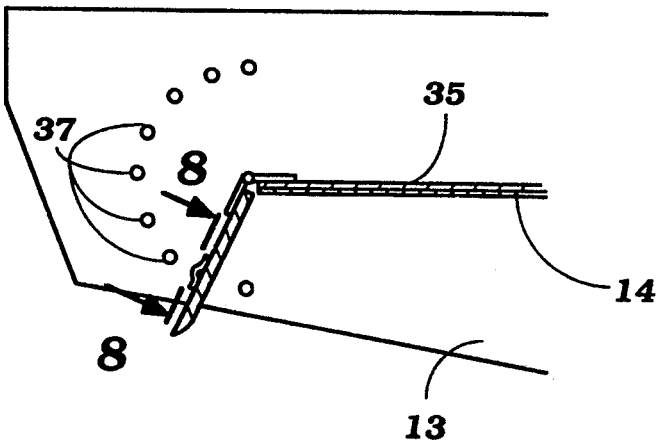
FIG. 7 is a cross sectional view showing how the angle of the rear portion of the rear deck can be adjusted.
Figure 8:
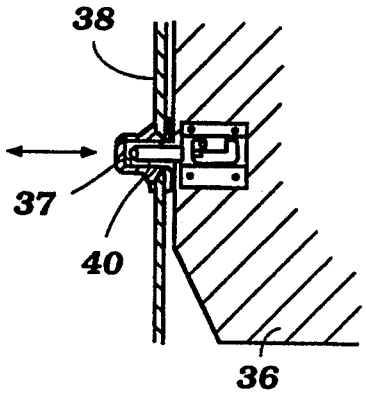
FIG. 8 is a cross sectional view taken along the line 8—8 of FIG. 7 and shows how the latching mechanism for the rear deck portion operates.
Figure 10:
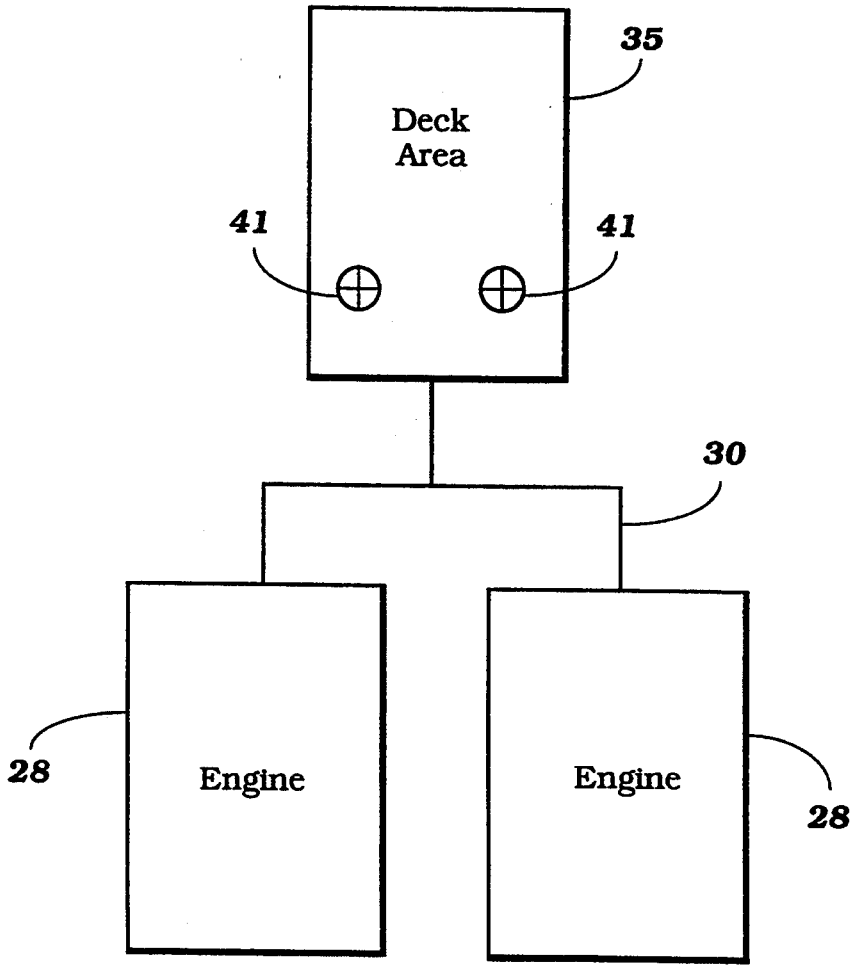
FIG. 10 is a schematic view showing how the engine coolant may be delivered to the deck area for heating the body of an injured person.

The area to the rear of the passenger's compartment 16 and between the engine compartments 27 and tunnels 31 provides a deck area 35 which is opened to the rear of the watercraft 11 and specifically through the transom so that injured persons may be drawn onto the deck area 35 in a manner which will be described. The rear portion of the deck area 35 is provided with a pivotally supported panel 36 which may be adjusted to any of a variety of angular positions as set by a plurality of ampetures 37 (FIGS. 7 and 8) formed in the side walls 38 of the hull surrounding the deck area 35. The panel 36 may be adjusted to any desired angular position as shown in FIG. 7 so as to facilitate the moving of an injured person onto the deck area 35. The panel 36 may then be pivoted upwardly so as prevent the injured person from falling off of the deck area 35 and also so as to form a dam that can be filled with heated water from the cooling jackets of the engines 28 for heat treatment of an injured individual. FIG. 10 shows schematically how coolant can be delivered from the cooling jackets of the engine 28 to the deck area 35 as by a conduit shown schematically at 30 in this figure. A sliding pin type latch 40 is provided at each side of the panel 6 to lock it in the respective position. A pair of drain openings 41 are provided in the deck area 35 and may be opened and closed so as to permit the heated water to be retained in this area or drained from it.

Figure 1:
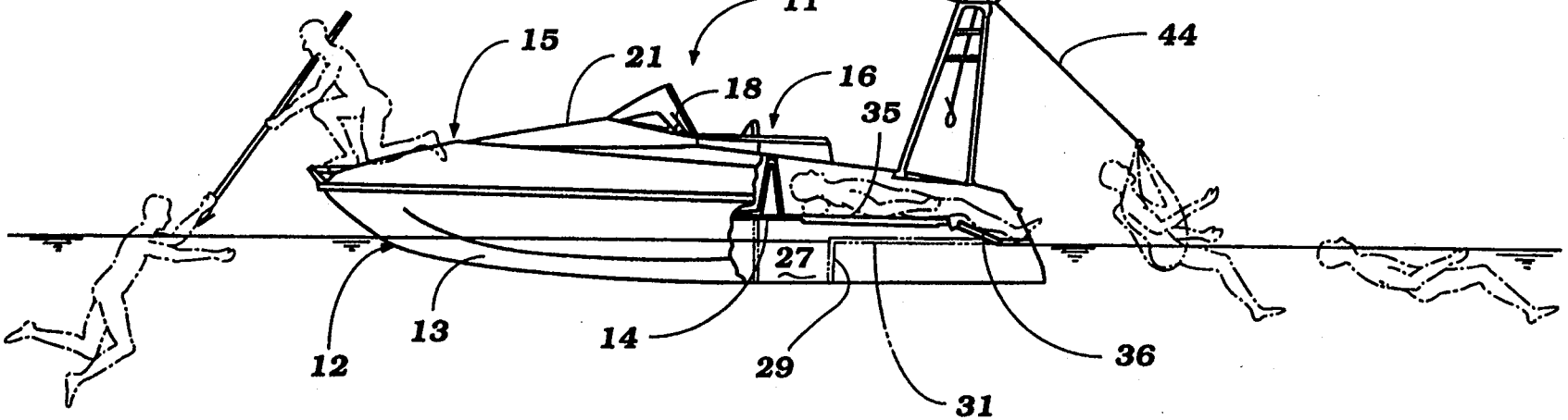
FIG. 1 is a side elevational view of a watercraft constructed in accordance with an embodiment of the invention and shows various ways in which the watercraft can be utilized to rescue persons from the body of water.
Figure 2:
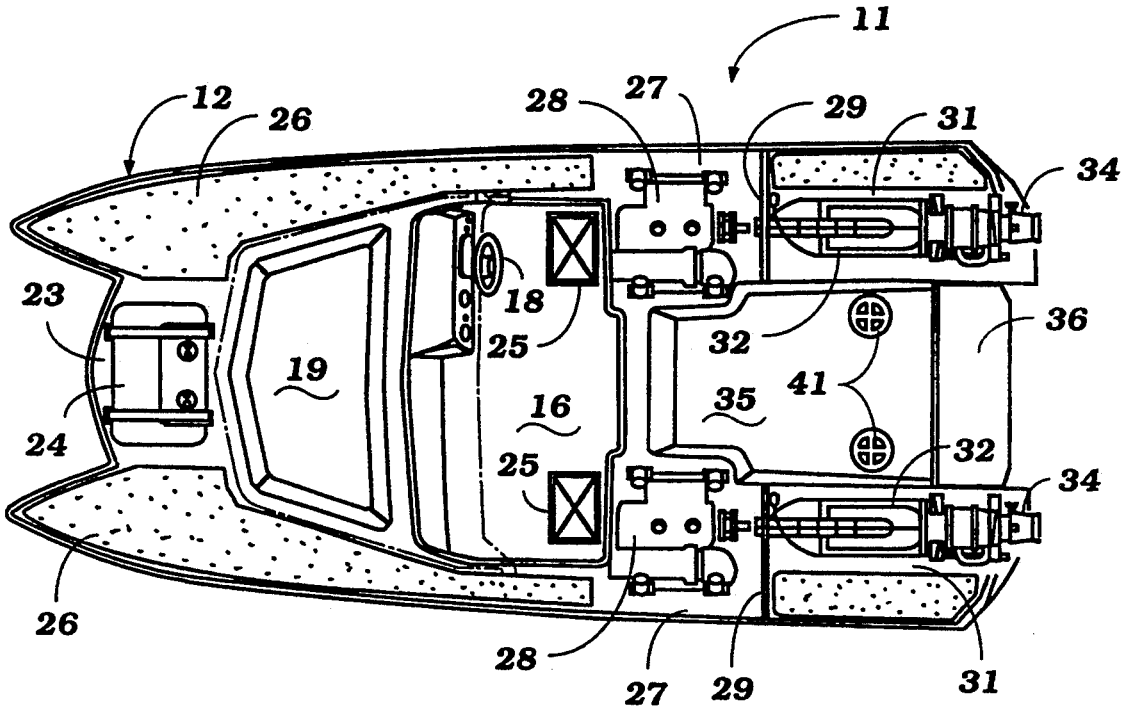
FIG. 2 is a top plan view of the watercraft, with portions broken away, so as to more clearly show the construction.
Figure 3:
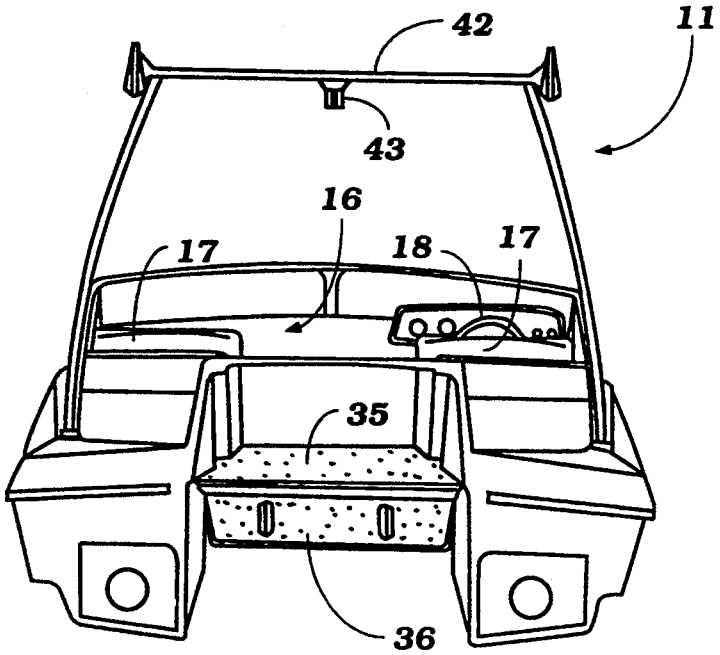
FIG. 3 is a rear elevational view thereof and shows the rear portion of the deck in its lowered position.
Figure 4:
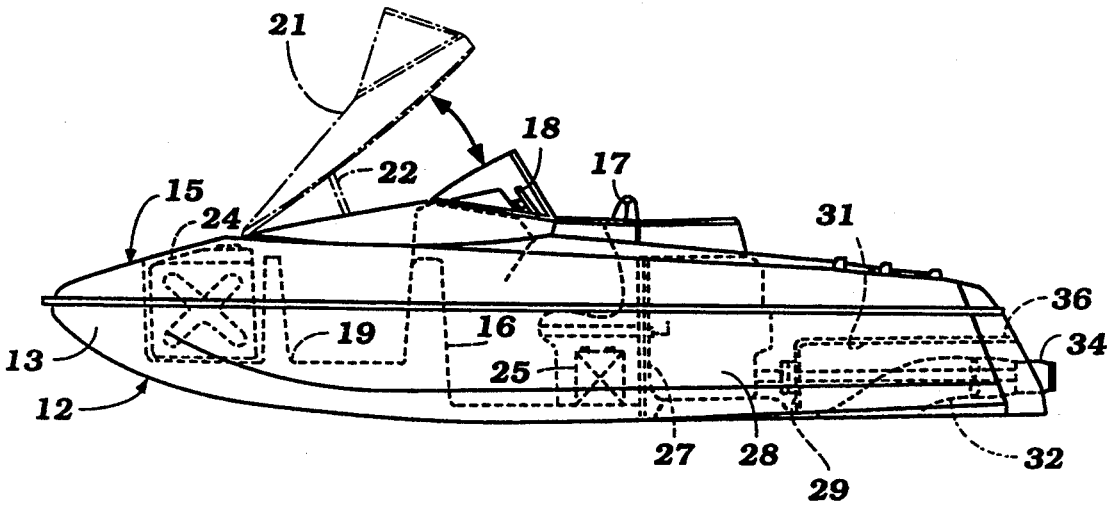
FIG. 4 is a side elevational view of the watercraft and shows how the hatch cover may be opened.
Figure 9:
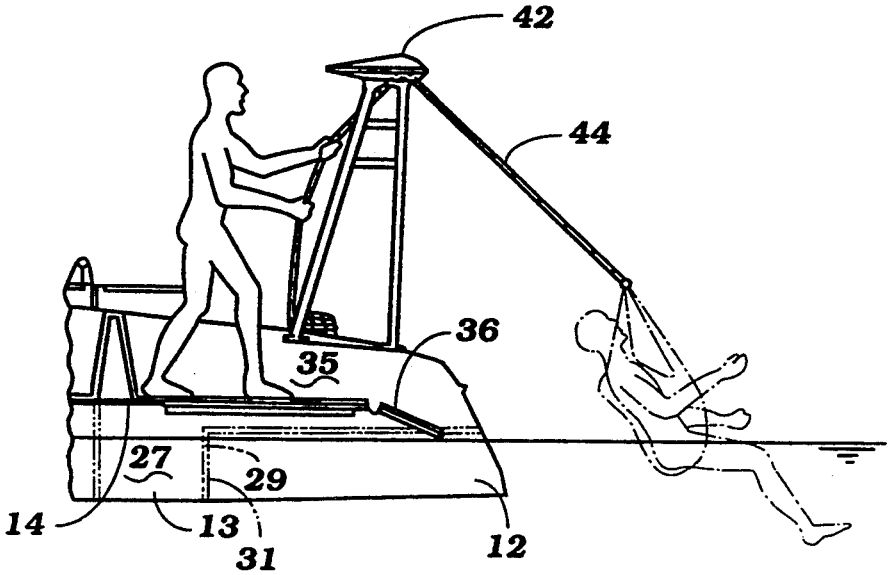
FIG. 9 is an enlarged side elevational view showing the transfer of an injured person onto the deck.

In order to assist in transporting injured persons onto the deck area 35, there is provided an bridge 42 which spans the deck area 35 and which has a pulley 43 formed therein to accommodate a rope 44 so as to assist in the movement of an injured person into the deck area 35 as clearly shown in FIGS. 1 and 9.

As has been previously noted, there is a gap between the forward portions of the catamaran hulls 13 and a deck piece 45 having perforated openings 46 is adapted to be detachably affixed to a flange 47 (FIGS. 5 and 6) formed on the peripheral edge of the hull portion 12 so as to accommodate a person standing at the front of the deck as shown in FIG. 1 for further rescue operations. The deck piece 45 may be easily removed so as to offer greater access and the perforated openings 46 offer a better foot grip by giving a textured configuration and permit drainage.

It should be readily apparent from the foregoing description that the described watercraft is particularly useful in providing a rescue or patrol boat and because of the use of the catamaran type hulls and side by side jet propulsion units, a large deck area is provided at the rear that will easily accommodate the transfer of injured persons onto the deck area and the treatment of these injured persons there.

Of course, the foregoing description is that of a preferred embodiment of the invention and various changes and modifications may be made without departing from the spirit and scope of the invention, as defined by the appended claims.

I claim:

1. A rescue boat comprising a hull having a transom, a deck opening through said transom and having a rear portion disposed substantially at the water level for facilitating the entry of injured persons onto said deck, selectively openable drain means for draining water from the deck area, and means for delivering coolant from an engine to the deck area for heating an injured person's body.

2. A rescue boat as set forth in claim 1 wherein the rear portion of the deck is pivotal for adjusting its position relative to the water.

3. A rescue boat as set forth in claim 2 wherein the pivotal deck portion is moveable between lowered into-the-water position and raised position for forming a dam to retain water in the deck area.

4. A rescue boat comprising a hull having a transom, a deck area opening through said transom and having a rear portion disposed substantially at the water level for facilitating the entry of injured persons onto said deck and a pair of propulsion devices, each provided on a respective side of said deck area and selectively openable drain means for draining water from said deck area, and means for delivering coolant from an engine driving at least one of said propulsion devices to the deck area for heating an injured person's body.

5. A rescue boat as set forth in claim 4 wherein a rear portion of the deck is pivotal for adjusting its position relative to the water.

6. A rescue boat as set forth in claim 5 wherein the pivotal deck portion is moveable between lowered into-the-water position and raised position for forming a dam to retain water in the deck area.

7. A rescue boat as set forth in claim 5 further including hoist means over the deck opening for assisting in drawing injured persons onto the deck.

* * * * *